US006585840B2

(12) United States Patent
Rabe et al.

(10) Patent No.: US 6,585,840 B2
(45) Date of Patent: Jul. 1, 2003

(54) PROCESS AND APPARATUS FOR ASSEMBLY OF GARMENTS

(75) Inventors: Gerald L. Rabe, Appleton, WI (US); Joseph R. Alberts, Greenville, WI (US); Joseph Daniel Coenen, Kaukauna, WI (US); Edward A. Drezdzon, II, Appleton, WI (US); Thomas David Ehlert, Neenah, WI (US); Donald Merlin Fries, deceased, late of Combined Locks, WI (US), administratrix Sharon Fries; Richard M. Konetzke, Menasha, WI (US); James Frederick Roth, Appleton, WI (US); Robert Eugene Vogt, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/751,413

(22) Filed: Dec. 28, 2000

(65) Prior Publication Data

US 2002/0084017 A1 Jul. 4, 2002

(51) Int. Cl.[7] ..... B32B 31/18

(52) U.S. Cl. ..... 156/73.3; 156/164; 156/229; 156/267; 156/269; 156/494; 156/515; 156/516; 156/518; 156/580.1

(58) Field of Search ..... 604/358, 393, 604/394, 396, 397, 402, 385.01; 156/73.1, 73.3, 73.4, 163, 182, 229, 250, 267, 391, 494, 510, 515, 518, 566, 580.1; 425/174.2, DIG. 108; 264/407, 288.4; 2/288.4, 244, 272, 300; 223/1, 2, 44, 49, 72, 111, 120; 271/7

(56) References Cited

U.S. PATENT DOCUMENTS

| | | | | |
|---|---|---|---|---|
| 4,496,360 A | | 1/1985 | Joffe et al. | 604/397 |
| 5,096,532 A | | 3/1992 | Neuwirth et al. | |
| 5,647,517 A | * | 7/1997 | Foster et al. | 223/2 |
| 5,790,983 A | | 8/1998 | Rosch et al. | |
| 5,876,394 A | | 3/1999 | Rosch et al. | |
| 5,907,872 A | | 6/1999 | Alberts et al. | |
| 5,953,754 A | | 9/1999 | Rosch et al. | |
| 6,009,558 A | | 1/2000 | Rosch et al. | |
| 6,149,637 A | | 11/2000 | Allen et al. | 604/366 |
| 6,205,591 B1 | * | 3/2001 | Wheeler et al. | 2/227 |

FOREIGN PATENT DOCUMENTS

| | | | |
|---|---|---|---|
| WO | 96/03950 | 2/1996 | |
| WO | WO 98/44883 | 10/1998 | A61F/13/15 |
| WO | 00/28845 | 5/2000 | |
| WO | 00/33678 | 6/2000 | |
| WO | 00/33679 | 6/2000 | |
| WO | 00/33680 | 6/2000 | |
| WO | 00/33681 | 6/2000 | |
| WO | 00/33682 | 6/2000 | |

OTHER PUBLICATIONS

US 5,915,536, 6/1999, Alberts et al. (withdrawn)
Wilson, D.: *Robotics Take a Brief on Assembly Lines*, Design Engineering, (Feb., 1998) pp. 17–18.

* cited by examiner

*Primary Examiner*—Richard Crispino
*Assistant Examiner*—Chan Sing Po
(74) *Attorney, Agent, or Firm*—Pauley Petersen Kinne & Erickson

(57) ABSTRACT

A process and apparatus for making a three-dimensional garment. The process is carried out by loading an insert onto an expandable/retractable process loop fixture. A waist elastic member can be bonded to a waist area of the insert. A garment shell can be applied over the insert and the waist elastic member. A waist area of the garment shell can be attached to the waist elastic member and to the waist area of the insert.

57 Claims, 13 Drawing Sheets

PROCESS AND APPARATUS FOR ASSEMBLY OF GARMENTS

FIELD OF THE INVENTION

The present invention relates to a process and apparatus for making three-dimensional garments.

BACKGROUND OF THE INVENTION

Garment manufacture involving the assembly of two or more components to form a three-dimensional garment is typically carried out by manual sewing. Attempts have been made to automate the process, but such automated methods of garment manufacture are typically costly and often inefficient. Attempts to automate the manufacture of durable garments, such as boxer shorts and swimsuits, have conventionally used sewing technology and have turned out to be infeasible. Automated methods of making absorbent garments often use frames around which diapers and training pants are assembled, leading to difficulty in stretching and holding three-dimensional garments while bonding and trimming the garments.

Furthermore, absorbent garments are normally produced along one product line and durable garments worn over the absorbent garments are normally produced along a separate product line, and are rarely, if ever, found in the same manufacturing facility. Having separately manufactured absorbent garments and durable garments results in considerable production facility costs and also leads to a considerable amount of work for a caretaker, namely laundry in addition to changing soiled absorbent garments.

There is thus a need or desire for an effective automated method and apparatus for manufacturing three-dimensional garments.

There is a further need or desire for an automated method and apparatus for manufacturing garments that can function as absorbent garments in combination with outer wear, in lieu of absorbent garments and separate durable garments.

SUMMARY OF THE INVENTION

In response to the discussed difficulties and problems encountered in the prior art, a new process and apparatus for making three-dimensional garments has been discovered.

The present invention is directed to a cost-effective method for making three-dimensional garments. The garment can be a disposable infant garment with a preformed trunk or skirt and a strip of waist elastic bonded to the waist area of a training pant-like insert. By altering the materials or product design, the method of the invention can be used to produce garments for a wide variety of uses, including disposable everyday wear or swimwear for incontinent children or adults, disposable trousers or skirts for children or adults, or even durable clothing or swimwear, such as shorts and skirts without an insert, shorts or skirts with a non-absorbent liner, or non-elasticized garments. The concepts in the method of the invention can be used to assemble three-dimensional garments other than shorts and skirts.

The method of the invention combines waist elastic, an insert, and a skirt or three-dimensional trunk into a finished garment by bonding these three elements together at the waistband area of the insert. The garment is bonded and trimmed on an expandable/retractable fixture. The expandable/retractable fixture is transported between process areas by a loop conveyor system or other transport device. The process loop is the heart of the production machine. Other sub-assembly loops can include an insert loading loop and a shell loading loop. The process loop moves in a continuous motion through an insert loading area, a waist elastic application area, a shell loading area, a waist bonding area, and optionally, a folding and stacking area.

DEFINITIONS

Within the context of this specification, each term or phrase below will include the following meaning or meanings.

"Attached" refers to the joining, adhering, connecting, bonding, or the like, of two elements. Two elements will be considered to be attached together when they are attached directly to one another or indirectly to one another, such as when each is directly attached to intermediate elements.

"Bonded" refers to the attachment of two elements through non-mechanical means such as thermal, ultrasonic or adhesive bonding. Mechanical means of attachment, such as sewing, are not considered to result in bonding as used herein.

"Fixture" refers to a component of a system, such as a process loop fixture that is part of a process loop. The fixture can move about within the system to convey the garment from one station to the next.

"Garment shell" refers to an outer cover or outer layer of a garment. In a single-ply garment, the single layer of the garment is the garment shell.

"Garment insert" refers to an inner layer of a garment. The garment insert provides a pant-like fit about a wearer's lower torso, thereby serving as a form of built-in underwear within the garment.

"Three-dimensional garment" refers to a garment that cannot be laid flat with all of its seams in one plane.

These terms may be defined with additional language in the remaining portions of the specification.

DETAILED DESCRIPTION OF THE PRESENTLY PREFERRED EMBODIMENTS

Figure 1:
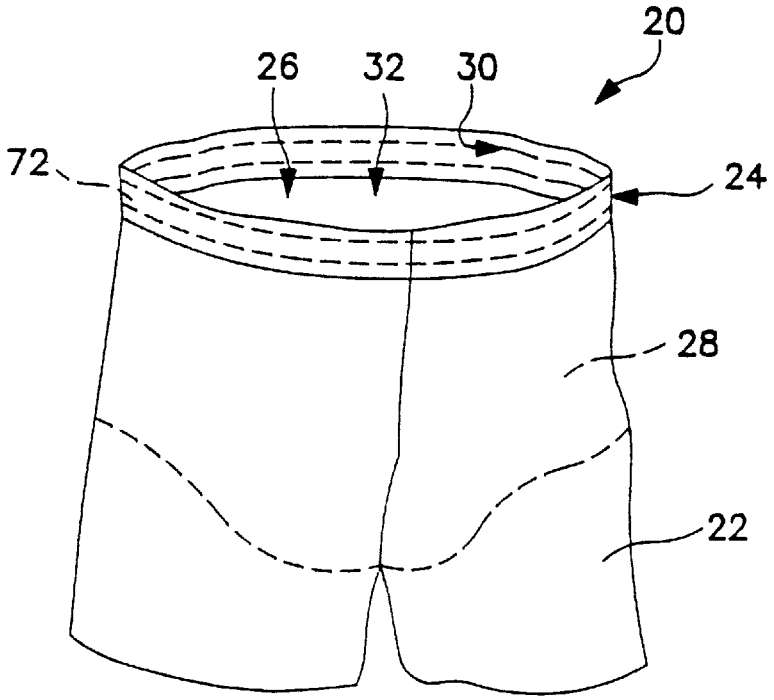
FIG. 1 illustrates a front view of a three-dimensional, pant-like, disposable absorbent article.
Figure 2:
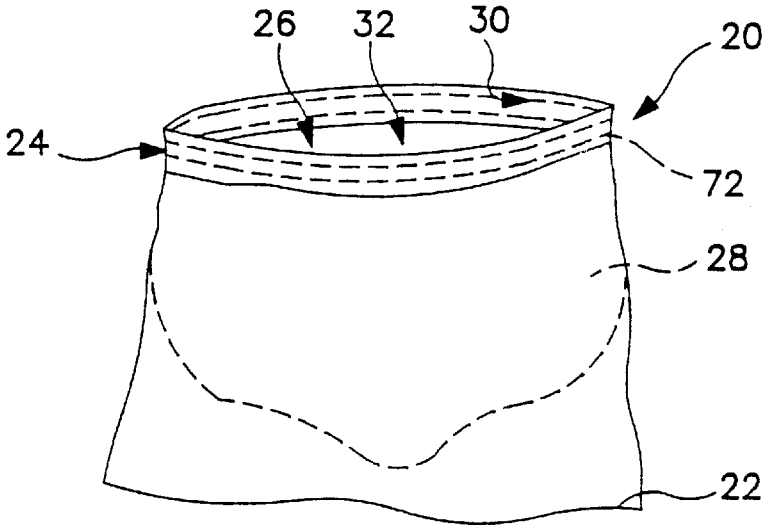
FIG. 2 illustrates a front view of a three-dimensional, disposable absorbent article including a skirt.

FIG. 1 shows a three-dimensional garment 20 with a garment shell 22 in the form of a pair of shorts and having an insert 28, and FIG. 2 shows another three-dimensional garment 20 with a garment shell 22 in the form of a skirt and having an insert 28. The garment shells 22 can either be made of a disposable material or a durable material. Similarly, the inserts 28 can either be made of a disposable material, suitably with an absorbent feature within the insert 28, or a durable material. These garments 20, and garments having a similar construction, can be disposable absorbent garments, such as pants, shorts, skirts or swimsuits, for incontinent children or adults. Alternatively, these garments 20 and garments having a similar construction can be durable garments, such as pants, shorts, skirts or swimsuits, with a non-absorbent insert. The method and apparatus of the invention can be used to make any of these three-dimensional garments 20, as well as three-dimensional garments not having an insert.

Figure 3:
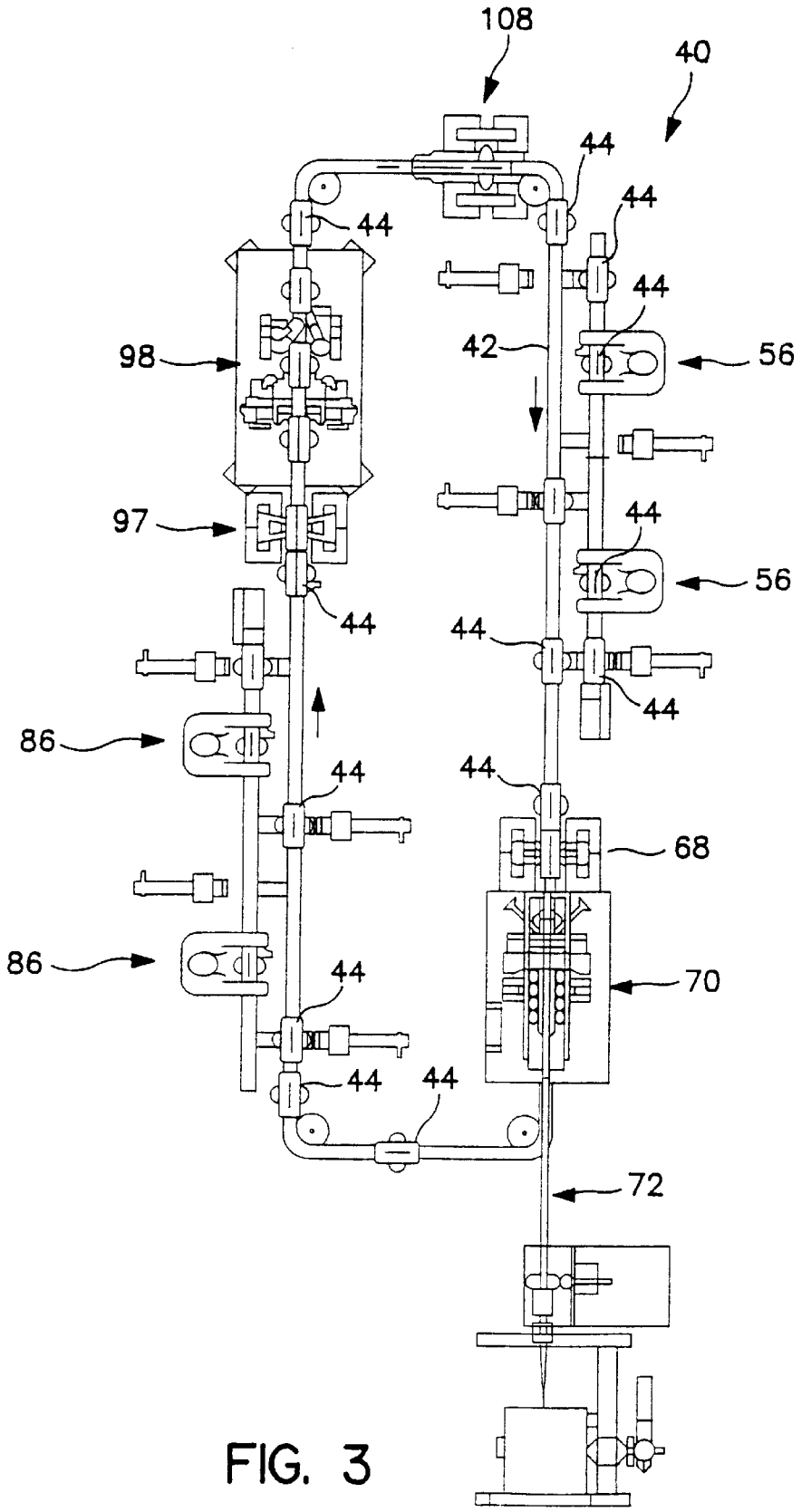
FIG. 3 schematically illustrates a semi-automated process for making a three-dimensional garment.
Figure 4:
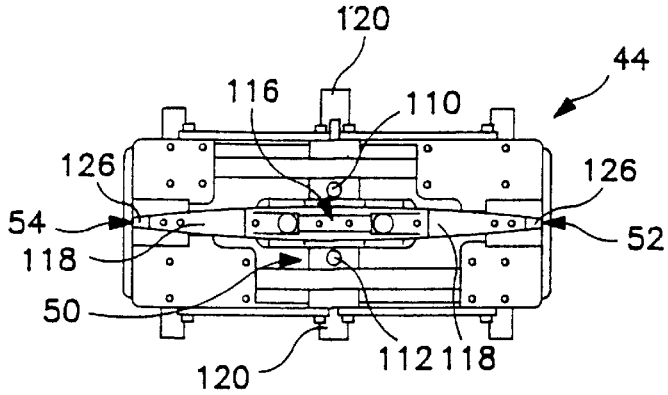
FIG. 4 illustrates a top view of a process loop fixture.

Referring to FIG. 3, a schematic illustration of apparatus 40 for a semi-automated process for making three-dimensional garments 20 is shown. The apparatus 40 is centered around a process loop 42 that moves in a continuous motion through adjacent process areas. The adjacent process areas, as shown, include at least one insert-loading station 56, a partial-expand station 68, a waist elastic applicator station 70, at least one garment shell-loading station 86, a full-expand station 97, a waist band bonding device 98 and a retract station 108.

A number of process loop fixtures 44 are transported about the process loop 42. An example of a suitable process loop fixture 44 is shown in FIGS. 4–8. The process loop fixture 44 is an expandable and retractable device, and can include an ultrasonic bonding anvil 46 and a trimming groove 48. An expanding and locking mechanism 50 is also included on the process loop fixture 44 to enable the expansion and retraction capabilities of the fixture. One example of a suitable expanding and locking mechanism 50 is a three-position locking device.

The process loop fixture 44 shown in FIGS. 4–8 includes one example of a three-position locking device. The fixture 44 includes two posts of different heights, a shorter post 110 and a taller post 112 (see FIG. 8), both projecting upwards from a base 114 of the fixture 44. A central portion 116 of the fixture 44 includes roughly one-third of both the anvil 46 and the cutting groove 48 and can move up and down. Two outer portions 118 are able to move horizontally toward and away from the central portion 116 of the fixture 44. The motions of the two outer portions 118 are driven by the motions of the central portion 116, as described in further detail below. The central portion 116 also includes a sliding lock bar 120 that can move into three positions. The lock bar 120 is aligned with the two posts 110, 112, and the bar includes an elongated aperture (not visible) through which the posts can pass, if the bar is aligned correctly.

Figure 5:
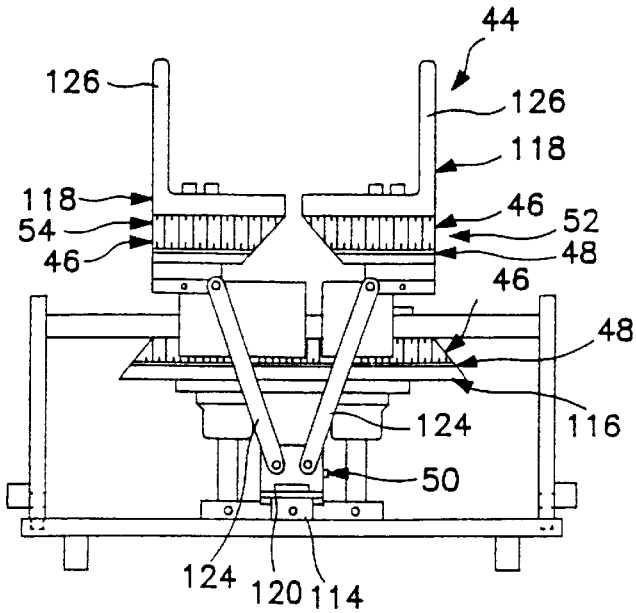
FIG. 5 illustrates a front view of a process loop fixture in a retracted state.

In a fully retracted or unexpanded state of the fixture 44, shown in FIG. 5, the central portion 116 of the fixture is at its lowest position because the locking bar 120 is in a position that allows both posts 110, 112 to pass through the aperture in the bar. The lowest position of the central portion 116 corresponds to the unexpanded state because a plurality of bars 124 mounted on bolts or similar hardware connect the central portion 116 to the two outer portions 118 of the fixture 44 such that the bars 124 can rotate on bolts and change their angles relative to each other and to the floor. Thus, the bars 124 drive the inward and outward motions of the outer portions 118 off of a vertical position of the central portion 116. When the central portion 116 is fully lowered, the bars 124 are closest to vertical, and the two outer portions 118 are drawn in. The two outer portions 118 include supports 126 around which the garment components are placed. Thus when the supports 126 are closest together, the product components are unexpanded.

Figure 6:
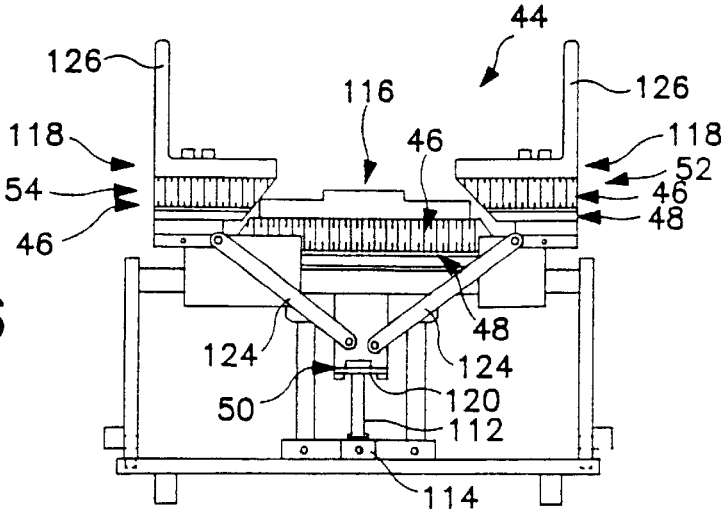
FIG. 6 illustrates a front view of a process loop fixture in a partially expanded state.

When the fixture 44 reaches the partial-expand station 68, a first actuator moves the central portion 116 of the fixture 44 upwards at or above the height of the shorter post 110, and a second actuator moves the locking bar 120 so that the shorter post 110 is no longer lined up with the aperture in the bar. The other aperture is, however, still lined up with the taller post 112. Therefore, when the actuators release the fixture 44, the locking bar 120 rests on top of the shorter post 110 and holds the central portion 116 of the fixture 44 at the partially raised position, as shown in FIG. 6. In this partially raised position, the bars 124 between the central portion 116 and the two outer portions 118 are moving towards being horizontal, and they are pushing the two outer portions 118 outward. This intermediate position of the outer portions 118 creates the middle, or partial-expand, position for the garment component that is mounted on the supports 126 on the outer portions 118. Beneficially, the fixture 44 remains stable in this partially expanded position as the fixture continues to travel around the process loop 42.

Figure 7:
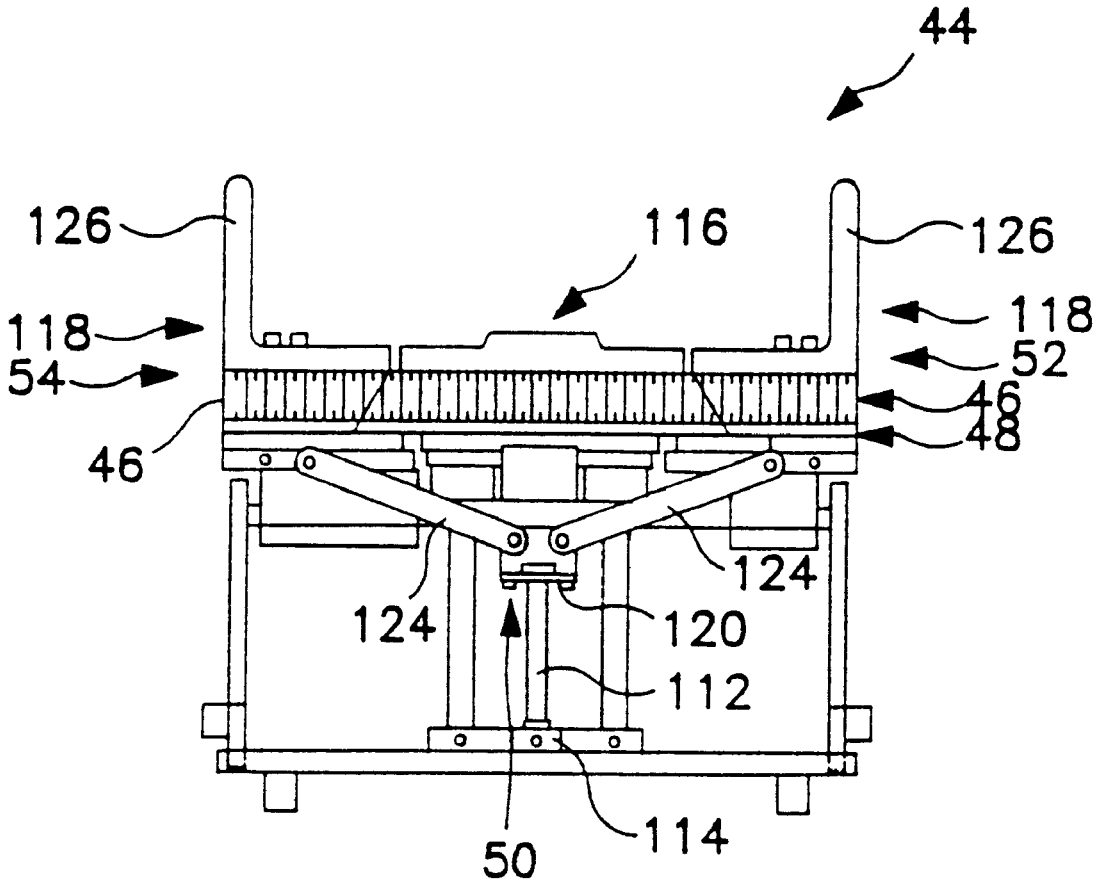
FIG. 7 illustrates a front view of a process loop fixture in a fully expanded state.
Figure 8:
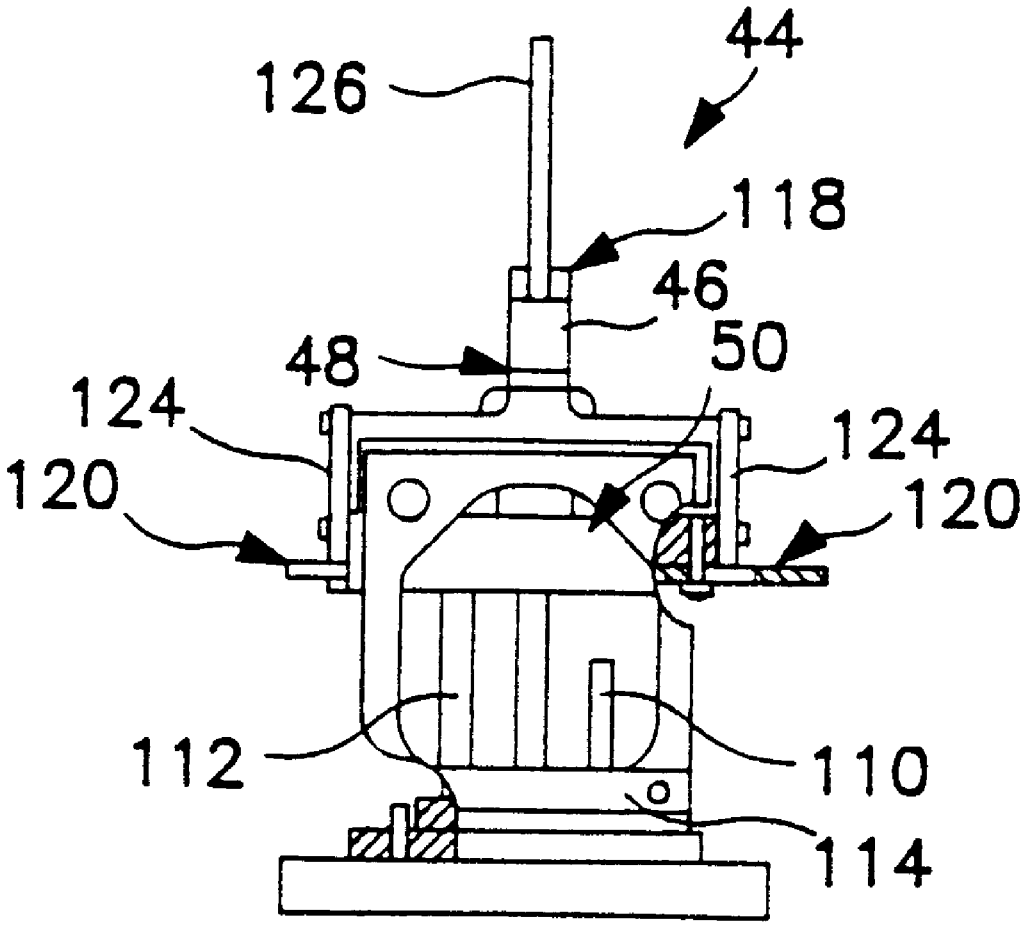
FIG. 8 illustrates an end view of a process loop fixture.
Figure 9:
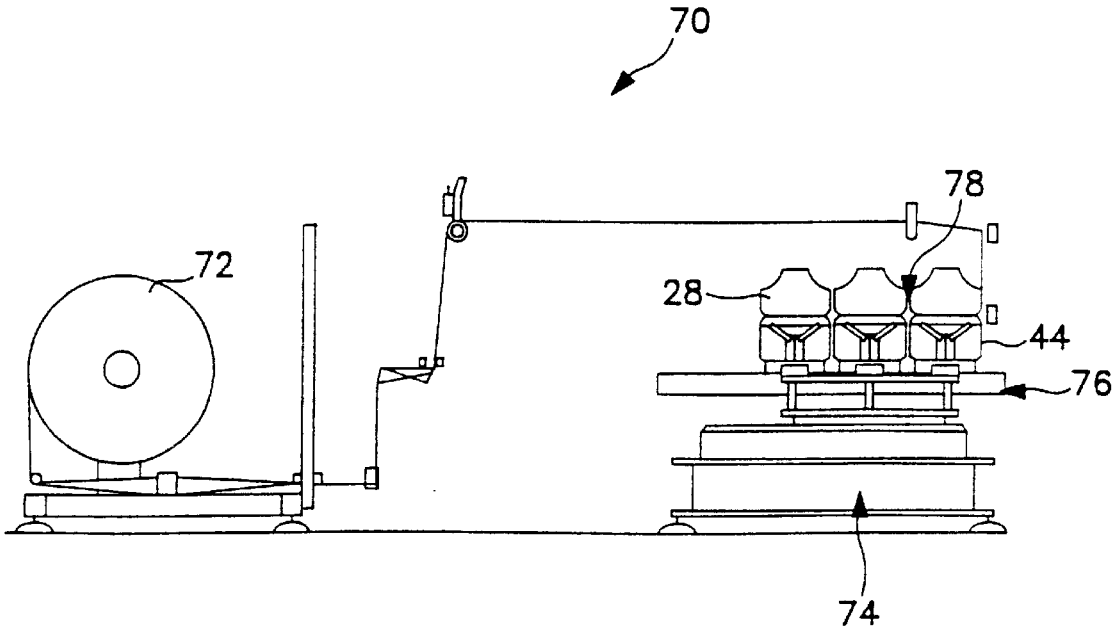
FIG. 9 illustrates a front view of a waist elastic application station.

When the fixture 44 reaches the full-expand station 97, the central portion 116 of the fixture 44 is raised to its fully raised position, wherein the anvil 46 and slitting grooves 48 become continuous. The fully raised, or fully expanded, position is shown in FIG. 7. The raising is accomplished in a manner similar to the partial-expand station with two actuators, and the locking bar 120 is moved to a position where the aperture no longer lines up with the taller post 112. Thus, when the fixture 44 is released, the central portion 116 of the fixture 44 rests on the taller post 112 and is held in its highest position. The bars 124 connecting the central 116 and outer portions 118 of the fixture 44 are closest to horizontal, and they have pushed out the outer portions 118 to their greatest distance apart. In this position, the garment component carried on the supports 126 is stretched to its fully-expanded position.

Other devices can be used to accomplish the same type of motions for expanding the garment components. For example, a cam can be used within the fixture 44 to raise and lower the central portion. Other ways to expand the garment components could be developed, such as interlocking plates similar to those in a camera lens.

The process loop fixtures 44 can be transported about the process loop 42 in several different ways. For example, a loop conveyor system can be used. Alternative transport methods include a multi-lane power and free conveyor system to merge output from several loaders into single lanes for elastic and bonding processes, an oval track device, or a rotary turret device. The process loop fixtures 44 can be top-mounted or bottom-mounted on the process loop 42.

As shown in FIG. 3, each process loop fixture 44 begins the semi-automated method of the invention at the in sert-loading station 56, where a pant-like insert can be manually placed on the process loop fixture 44 such that a waist area of the insert is placed on top of the anvil 46 on the fixture 44. Once the insert is in place on the fixture, the fixture is moved on to the partial-expand station 68 where, as described above, the fixture is partially expanded into the position shown in FIG. 6. The fixture 44 is not fully expanded at this point, thereby allowing easy fit of a garment shell 22 over the insert 28 later in the process.

Once the fixture is partially expanded, the fixture is then moved on to the waist elastic applicator station 70 where an elastic waistband can be placed on the waist area 30 of the insert 28. A pre-formed loop of waist elastic can be manually placed on the insert or, alternatively, a waist elastic member 72, suitably a rolled elastic web, can be unwound, drawn to a specific tension and/or length, slit in half, and delivered to an applicator section 74. The applicator section 74 includes a walking beam indexer 76, a bonder 78, and at least two web guides 80, as shown in FIGS. 10–15. FIGS. 10–15 illustrate the waist elastic application process.

Figure 10:
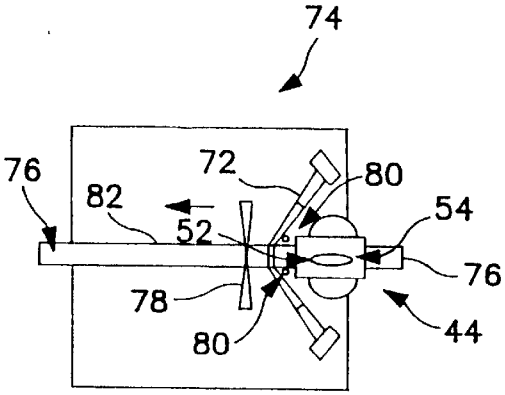
FIGS. 10–15 illustrate a step-wise process for applying waist elastic to a pant-like insert.
Figure 11:
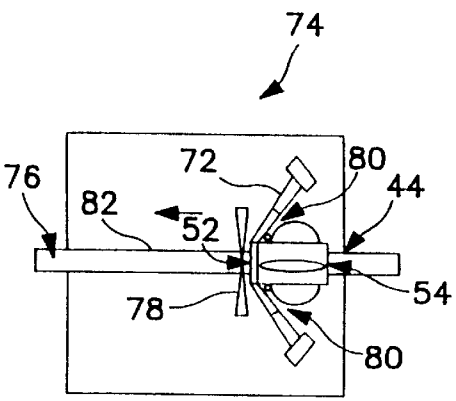
Figure 12:
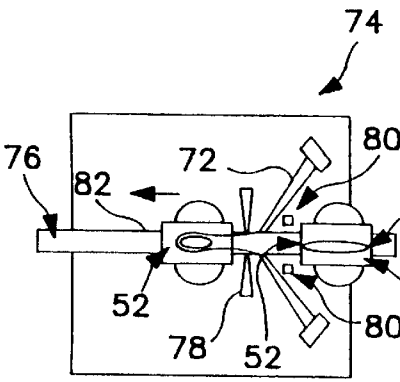
Figure 13:
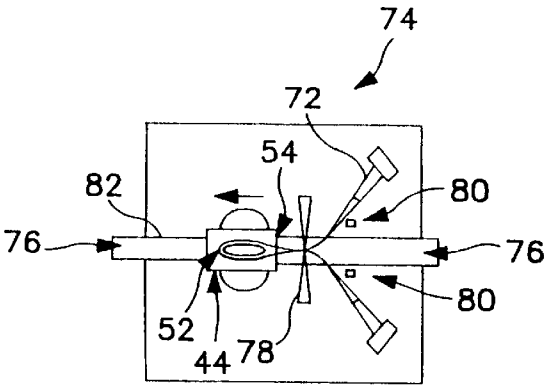
Figure 14:
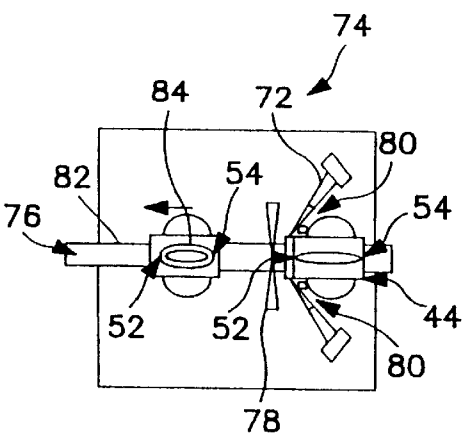
Figure 15:
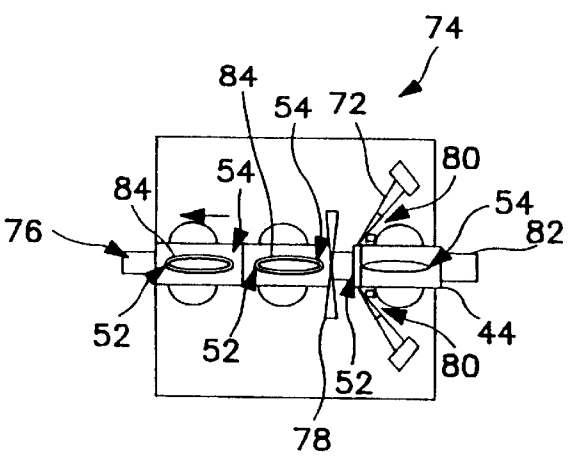

FIG. 10 shows a top view of the partially expanded process loop fixture 44 entering the applicator section 74. FIG. 11 shows the partially expanded process loop fixture 44 stopped in position behind the elastic web 72. The walking beam 76 lifts the process loop fixture 44, indexes it forward one product pitch, and sets it down on a set of guide rails 82 above the process loop 42. FIG. 12 shows the process loop fixture 44 indexed forward and a second process loop fixture 44 in place behind the first. A leading edge 52 of the process loop fixture 44 along a waist area 30 of the insert 28 contacts the elastic web 72 and pulls the web along during the index move, thereby tensioning the elastic web. The elastic web 72 that has been guided along both sides of the process loop fixture 44 around the waist area 30 of the insert 28 then extends from a trailing edge 54 of the fixture 44 through the bonder 78, still in a tensioned state. The bonder 78 can bond the webs 72 and simultaneously cut through the center of the bond, thereby forming an elastic waist band loop 84 on one side of the cut and a web splice on the other side. FIG. 13 shows the bonder 78 bonding and cutting the elastic web 72. The waist band loop 84 then snaps forward to the fixture 44, as shown in FIG. 14, and the web splice snaps back to the web guide bars 80, ready for the next fixture 44. When the second fixture 44 is in position, the process is repeated. The walking beam 76 then lifts the first and second fixtures 44 and indexes them forward one product pitch while a third fixture 44 moves into position, as shown in FIG. 15. Suitable ultrasonic bonders may be obtained from Branson Sonic Power Company of Danbury, Conn.

Further alternative methods of forming the waist elastic member 72 around the waist area 30 of the insert 28 include separating the web bonding and web cutting into two process steps by adding another station to the walking beam indexer 76, or redesigning the process to apply the elastic 72 to continuously moving fixtures rather than indexing fixtures. Another alternative would be to laminate the elastic material 72 in line with the walking beam 76 rather than the elastic being supplied on rolls. As shown in FIGS. 9–15, the elastic 72 can be ultrasonically bonded to the insert 28. Alternatively, the elastic 72 can be attached to the insert 28 with adhesive. The waist elastic applicator station 70 and elastic waistband are optional, since the insert may already be equipped with waist elastic.

After the waist elastic is in place around the insert 28, the fixture 44 supporting the insert and waist elastic are then moved on to the garment shell-loading station 86 where a garment shell 22 can be manually placed over the waist elastic 72 and the insert 28 such that the waist area 30 of the insert 28 is aligned with a waist area 24 of the garment shell 22 with the waist elastic 72 between the insert 28 and the garment shell 22. Alternatively, the waist elastic applicator station 70 can be located past the garment shell-loading station 86 such that the waist elastic is applied over an outer surface of the garment shell 22.

After the insert 28, the waist elastic 72 and the garment shell 22 are in place on the fixture 44, the fixture is then moved on to the full-expand station 97 where, as described above, the fixture is fully expanded into the position shown in FIG. 7. The fully expanded fixture 44 expands the garment enough to bring a waist opening 32 of the insert 28 to a size roughly equal to a waist opening 26 of the garment shell 22, as shown in FIGS. 1 and 2, before bonding the waist area 24 of the garment shell 22 to the waist area 30 of the insert 28.

Figure 16:
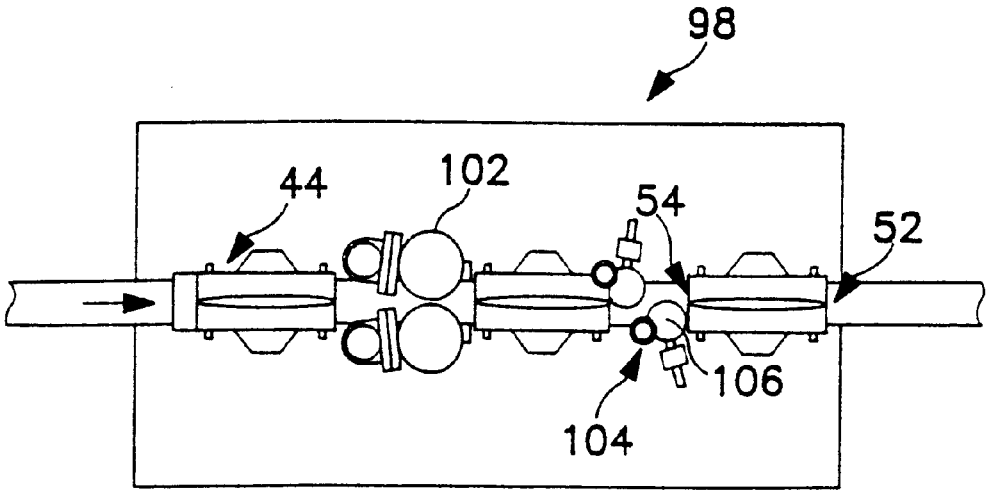
FIG. 16 illustrates a top view of a waist band bonding device.
Figure 17:
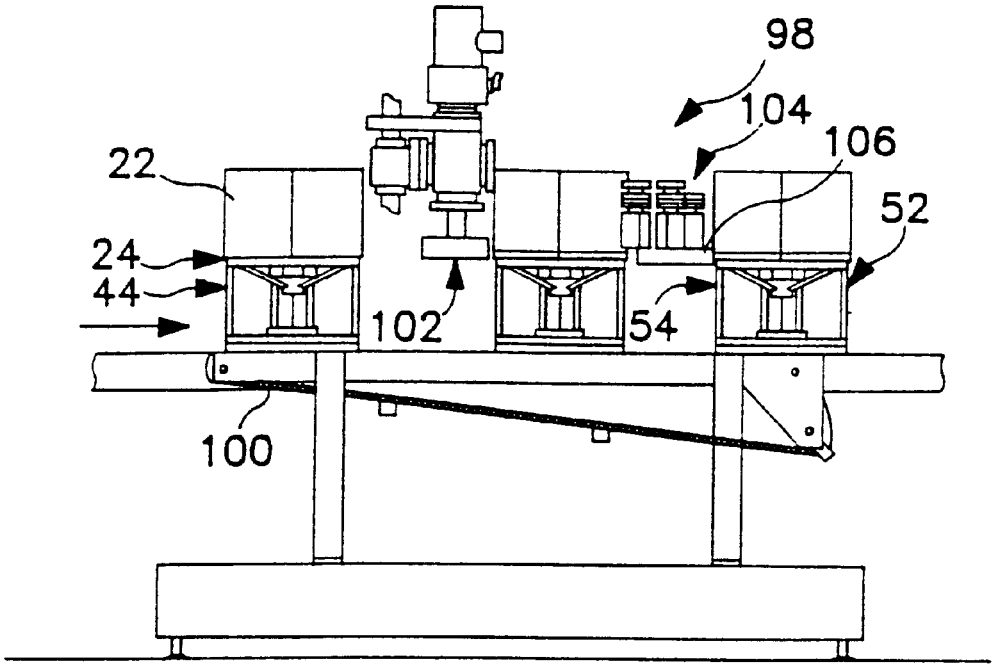
FIG. 17 illustrates a front view of a waist band bonding device.

Once the fixture 44 is fully expanded, the fixture is then moved on to the waist band bonding device 98 which bonds the garment shell 22, waist elastic 72 and insert 28 together about the waist area of the resulting garment. When the fixture 44 reaches the waist band bonding device 98, a lug conveyor 100 engages the fixture 44 and drives it through the bonding and trimming process, as shown in FIGS. 16 and 17. At least one pair of opposing rotary ultrasonic bonders 102 is pressed against opposite sides of the fixture 44 in the region of the anvil 46 as the fixture 44 passes between the bonders 102. The waist area 24 of the garment shell 22 is thereby bonded to the waist area 30 of the pant-like insert 28, with the waist elastic member 72 between the garment shell 22 and the insert 28, through the interaction between the rotary ultrasonic bonders 102 and the anvil 46 on the process loop fixture 44. As mentioned, the waist elastic member 72 can be bonded to the outer surface of the garment shell 22 rather than between the garment shell 22 and the insert 28. Suitably, the process loop fixture 44 has bullet-shaped, or elliptical, leading and trailing edge profiles 52, 54, thereby allowing bonding completely around the waist band of the resulting garment 20. A suitable system for performing rotary ultrasonic bonding is described in U.S. Pat. No. 5,096,532 issued Mar. 17, 1992, to Neuwirth et al.

Alternative methods of attaching the waist area of the insert 28 and garment shell 22 include using a system of opposing blade horn bonders in place of rotary bonders 102, or using a process loop fixture 44 having a round profile so that the fixture 44 can rotate against a rotary or stationary blade horn to complete the bond, or using adhesives or thermal bonding rather than ultrasonic energy. Furthermore, the waist area of the insert 28 and garment shell 22 can be sewn together with an automatic sewing head rather than ultrasonic energy. Suitable blade horn bonders are available from Branson Sonic Power Company of Danbury, Conn.

The waist band bonding device 98 can also include a trimming device 104, such as a pair of opposing rotary fabric saw trimmers, for trimming edges in the waist area of the resulting garment 20. In particular, the waist area 30 of the pant-like insert 28 and/or the waist area 24 of the garment shell 22 can be trimmed using the trimming device 104. The opposing rotary fabric saw trimmers can be pressed against opposite sides of the process loop fixture 44. Blades 106 of the trimmers should align with the groove 48 in the process loop fixture anvil 46 (FIGS. 5–7) without making contact with one another. A small portion of material is then trimmed away at the waist area creating a clean edge on the garment 20. Other suitable trimming devices 104 include scoring, shearing, or using a laser. Alternatively, the edges of the insert 28, the waist elastic member 72 and the garment shell 22 could be aligned neatly enough such that no trimming is required. Once the edge of the waist area of the resulting garment 20 is satisfactorily trimmed and/or aligned, the lug conveyor 100 then pushes the process loop fixture 44 back onto the process loop 42 for transport to the next station.

The retract station 108, or removal station, includes a retract mechanism similar to the partial and full expansion stations. The retract station 108 returns the fixture 44 to its retracted position, as shown in FIG. 5, thereby allowing easy removal of the garment from the fixture. Once the garment is removed from the fixture 44 it can be folded and packaged.

In an alternative embodiment of the invention, the garments can be made using an automated process, rather than a semi-automated process. In the automated process, illustrated in FIG. 18, each process loop fixture 44 begins the automated method of the invention at the insert-loading station 56, shown in FIG. 8. The insert-loading station 56 includes at least one insert loop fixture 58, similar to the process loop fixture 44 in that the insert loop fixture 58 is also expandable and retractable. The insert-loading station 56 also includes a track 60 that is synchronized with the process loop 42 such that the insert loop fixtures 58 travel around the track 60 and coincide with the process loop fixtures 44 as the process loop fixtures 44 travel around the process loop 42.

Figure 19:
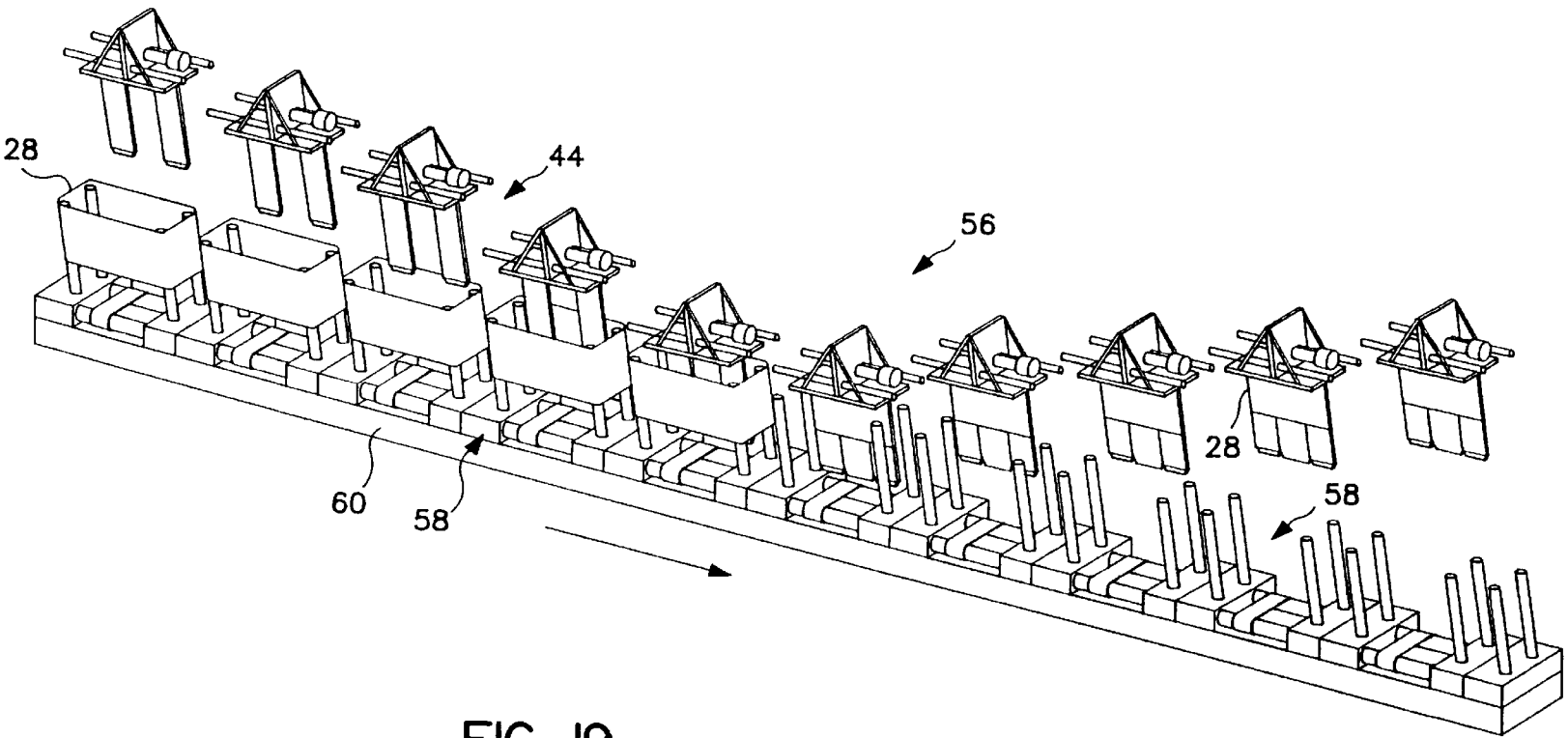
FIG. 19 illustrates a perspective view of an insert-loading station.

The insert loop fixtures 58 expand inside of the inserts 28 to hold the inserts open for easy insertion of the process loop fixtures 44. The insert loop fixtures 58 are suitably bottom-mounted on the track 60, such that the top-mounted process loop fixtures 44 can be lowered, or cammed down, onto the insert loop fixtures 58, penetrating the inserts 28 and partially expanding as the insert loop fixtures 58 contract. The insert loop fixtures 58 can then be cammed back up, thus picking up the pant-like inserts 28 and transferring them to the process loop 42, as shown in FIG. 19. Furthermore, a return conveyor (not shown) can be used to move fixtures 58 that have not been properly loaded back along the route of the track 60 for another pass through the insert-loading step.

Figure 18:
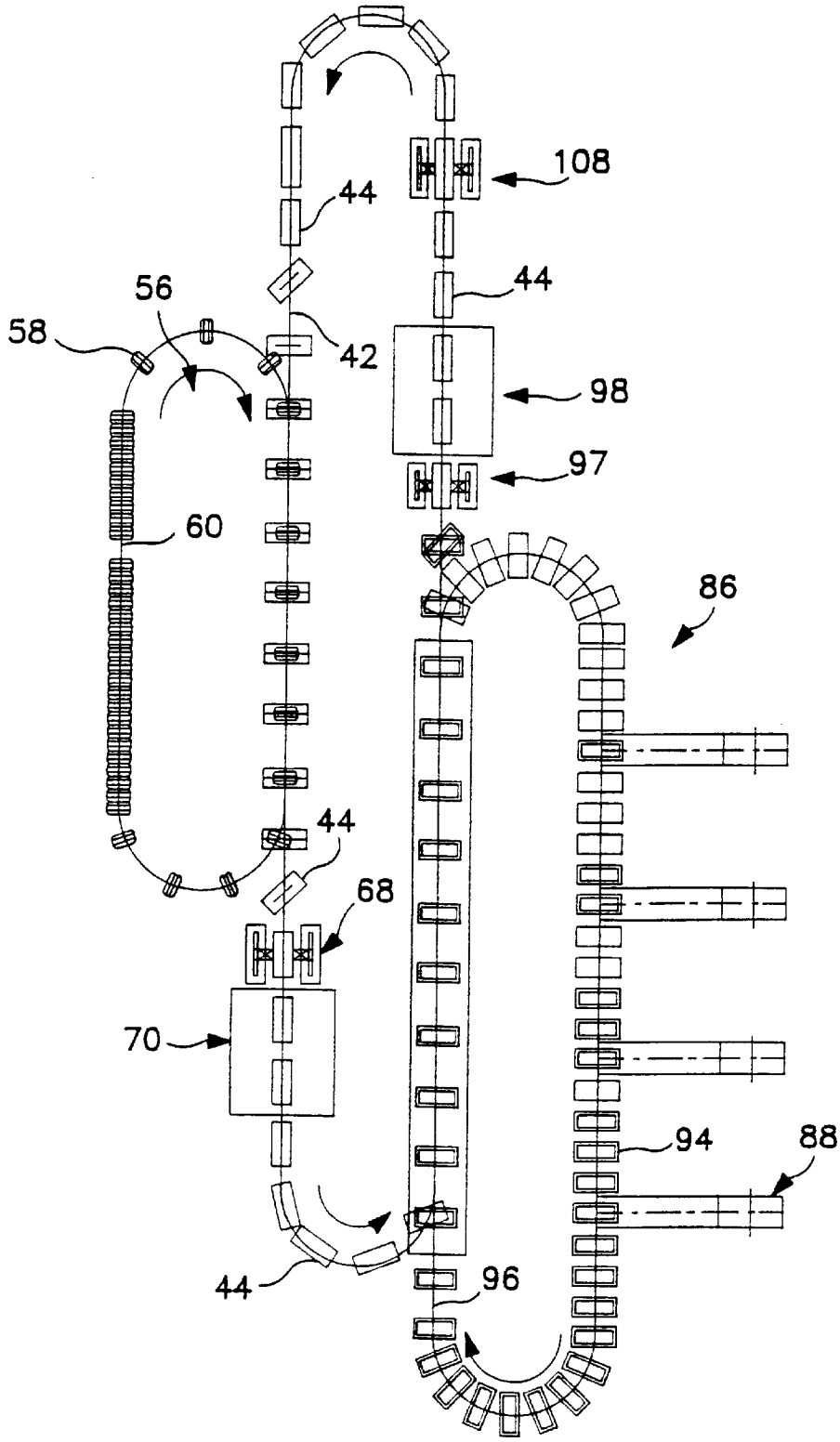
FIG. 18 schematically illustrates an automated process for making a three-dimensional garment.

The process loop fixtures 44 are partially expanded, either while the insert 28 is being loaded onto the process loop fixture 44, as described above, or after the insert 28 has been loaded. The partial-expand station 68 can be located adjacent the process loop 42, as shown in FIG. 18, at which point the station 68 can partially expand the process loop fixture 44 and the insert 28 in preparation for application of a waist elastic member to the insert 28.

Once the process loop fixtures 44 are partially expanded, the process loop fixtures 44 then convey the inserts 28 to the waist elastic application station 70, as described above.

Figure 20:
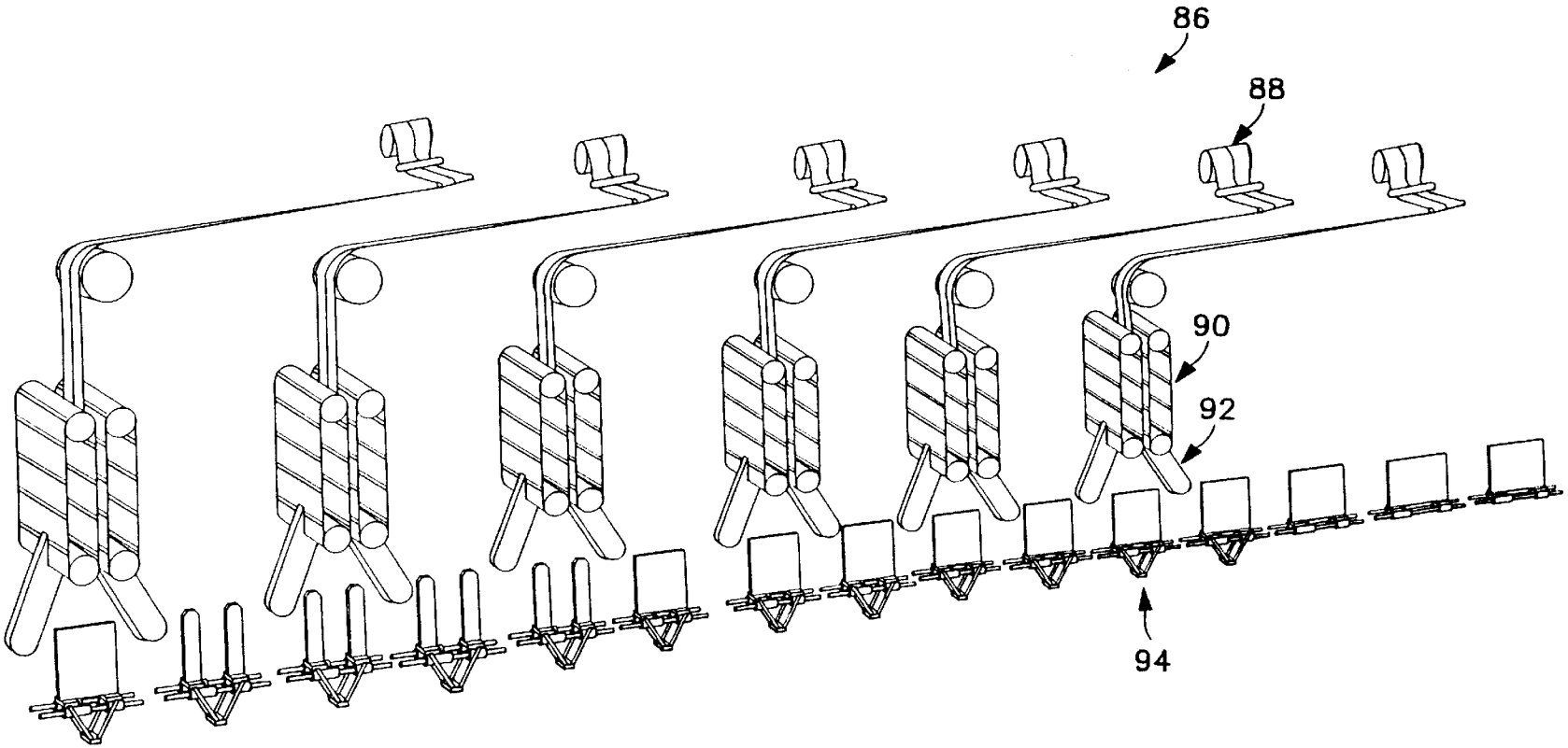
FIGS. 20 and 21 illustrate perspective views of a garment-shell loading station.
Figure 21:
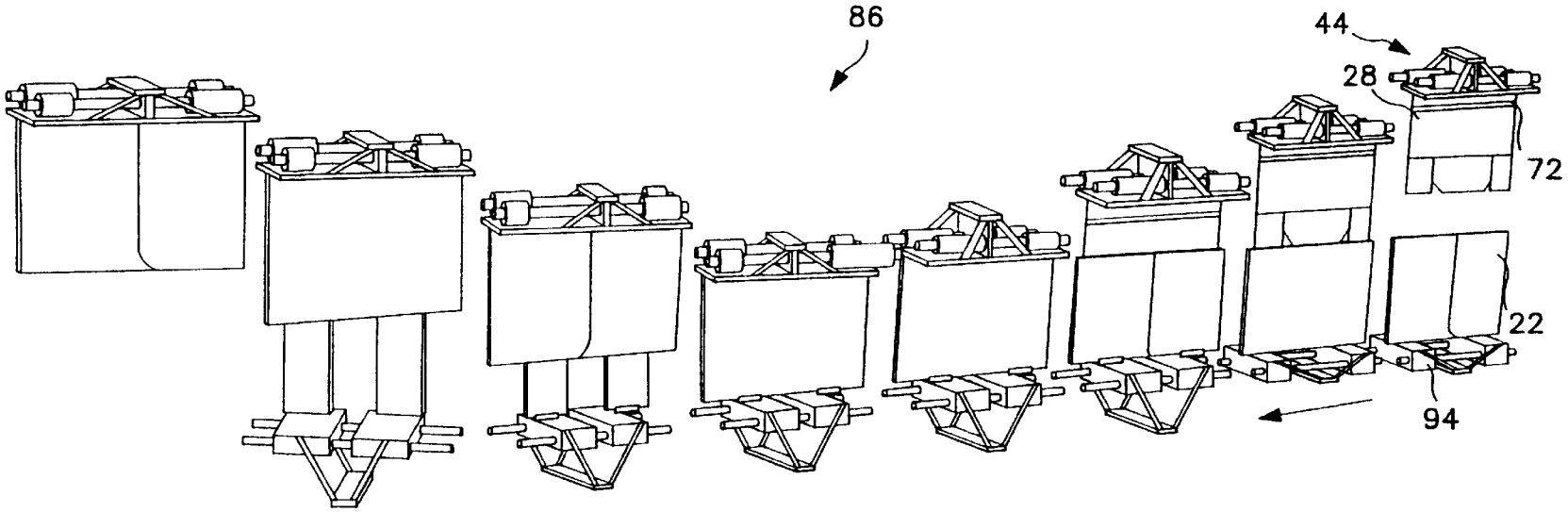

Once the waist elastic 72 is formed around the waist area 30 of the insert 28, the process loop fixture 44 moves the insert 28 to the garment shell-loading station 86, shown in FIGS. 20 and 21. The garment shells can be made in a continuous roll, for example, in accordance with the process disclosed in U.S. Pat. No. 5,915,536 issued Jun. 19, 1999 to Alberts et al., hereby incorporated by reference. The garment shell-loading station 86 or loop suitably includes at least one shell unwind 88, at least one product cut-off 90, at least one vacuum transfer belt 92, and at least one bottom-mounted expandable/retractable shell fixture 94, as shown in FIG. 20. The shell fixtures 94 can expand and retract, similar to the process loop fixtures 44 and the insert loop fixtures 58. The loop 96 of the garment shell-loading station 86 moves in synchronization with the process loop 42. The shell unwind 88 delivers a continuous web of pre-made trunk or skirt shells 22 to the product cut-off 90. After being cut to length, the shells 22 are opened by the vacuum belts 92 and conveyed onto the shell fixtures 94. Once a shell 22 is on a shell fixture 94, the shell fixture 94 expands and moves into alignment with the process loop 42. A process loop fixture 44, with the insert 28 and waist elastic member 72 already in place, cams down into the shell 22, expands as the shell fixture 94 retracts, and cams back up, as shown in FIG. 21. In this manner, the garment shell 22 is transferred onto the process loop fixture 44 over the pant-like insert 28 and the waist elastic member 72.

After the insert 28, the waist elastic 72 and the garment shell 22 are in place on the fixture 44, the fixture is then moved on to the full-expand station 97, as described above. Once the fixture 44 is fully expanded, the process loop fixture 44 is then guided along the process loop 42 to the waist band bonding device 98, described above. As mentioned, the waist band bonding device 98 can include a trimming device 104.

After the waist area of the garment is bonded, the fixture 44 moves on to the retract station 108, described above. A folding device (not shown), well known to those skilled in the art, can be integrated with the removal station 108. Furthermore, a pick-and-place device (not shown), well known to those skilled in the art, can also be present at the removal station 108 to move the finished products to a stacking, or packaging, device. The folding device and stacking device can be an integrated device as well. Once the finished garment is removed from the process loop fixture 44, the empty process loop fixture 44 moves back to the insert-loading station 56 and starts the process over again.

Alternative methods of removing the garments 20 from the process loop fixtures 44 include using a person, robot, or rotary turret indexer with multiple grippers, a vacuum conveyor, or nip rolls or belts to remove the product as the product is moving continuously.

As mentioned, the invention can be used to make three-dimensional disposable absorbent garments 20, such as skirts, swimsuits, or pant-like garments including pants or shorts. Alternatively, the invention can be used to make three-dimensional durable garments 20, such as skirts, swimsuits, or pant-like garments including pants or shorts, with a primary difference between the disposable garments and the durable garments being the pant-like insert 28. The disposable absorbent garments typically have an insert 28 with an absorbent feature, while the durable garments can have either a durable insert 28 or no insert 28 at all.

Figure 22:
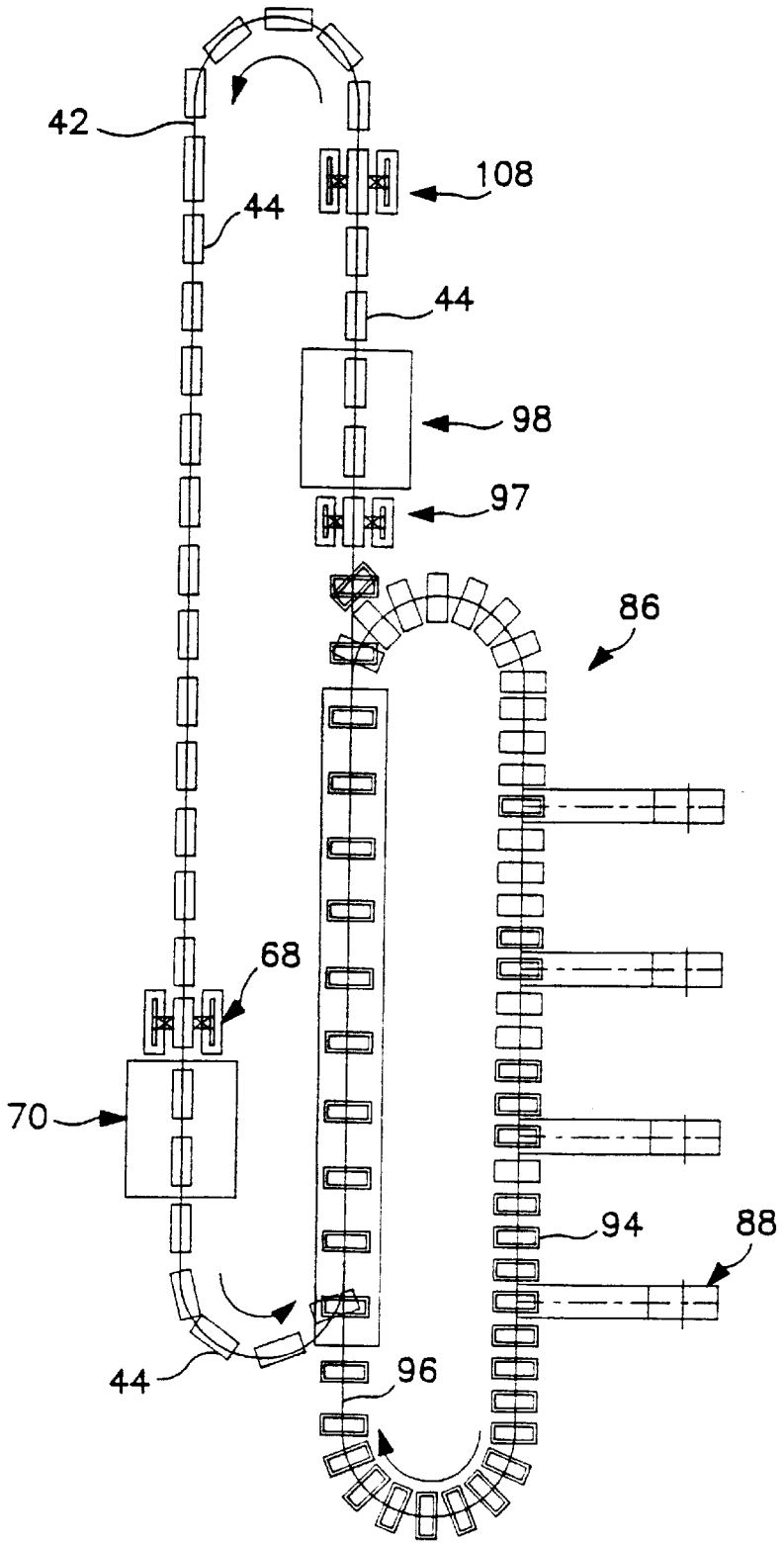
FIG. 22 schematically illustrates a process for making a three-dimensional garment without an insert.

In an alternative embodiment of the invention, illustrated in FIG. 22, the process and apparatus of the invention can be tailored to make a garment 20 without an insert 28. Either the semi-automated process or the automated process can be tailored to make a garment 20 without an insert 28. The process and apparatus are essentially the same as those used to make a garment with an insert, but without the insert. More particularly, the process involves partially expanding the process loop fixture 44 at an expand station 68, loading an elastic member 72 onto the process loop fixture 44 at a waist applicator station 70, loading a garment shell 22 onto the process loop fixture 44 at a garment shell-loading station 86. The process loop fixture 44 can expand and retract and is transported along a continuous process loop 42. The process loop fixture 44 may but need not necessarily be partially expanded. The process loop fixture 44 is fully expanded at a full-expand station 97, the waist elastic is bonded to the garment shell 22 at a waist band bonding device 98 and, finally, the process loop fixture 44 is retracted at a retract station 108 whereupon the finished garment can be removed from the process loop fixture 44. As in the previous embodiments, several different methods of bonding can be used to attach the waist elastic member 72 to the waist area 24 of the garment shell 22, including ultrasonic bonding, adhesive bonding, thermal bonding, or sewing the strip of elastic to the waist area 24 of the garment shell 22. The production rate of this embodiment is roughly the same as the previous embodiment, or faster considering fewer components are involved.

A wide range of materials is suitable for use in this invention. The pant-like insert 28 for a three-dimensional disposable absorbent garment 20 suitably includes a body side liner, an outer cover, and an absorbent assembly between the body side liner and the absorbent cover. An example of a suitable insert is a training pant, such as Huggies® Pull-Ups® Disposable Training Pants. The pant-like insert 28 for a three-dimensional durable garment 20 is suitably a type of cloth, such as cotton, nylon, or polyester. Similarly, the range of materials suitable for the garment shell 22 in a three-dimensional durable garment 20 is equally wide. In any case, a surface of the pant-like garment 20 which contacts a wearer's skin is desirably compliant, soft feeling, and non-irritating to a wearer's skin.

The garment shell 22 for a three-dimensional disposable absorbent garment 20 can be selected from a wide variety of materials, including elastic, stretchable, or nonstretchable materials. The garment shell 22 can be a single layer of material or a multi-layered laminate structure. One example of a suitable material is a 20 gsm (grams per square meter) spunbond polypropylene nonwoven web. The garment shell 22 may also be made of those materials of which the pant-like insert 28 is made. It is desired that the garment shell 22 provides a relatively cloth-like texture to the Wearer.

The waist elastic member 72 can be formed of any suitable elastic material. As is well known to those skilled in the art, suitable elastic materials include sheets, strands or ribbons of natural rubber, synthetic rubber, or thermoplastic elastomeric polymers. The elastic materials can be stretched and adhered to a substrate, adhered to a gathered substrate, or adhered to a substrate and then elasticized or shrunk, for example with the application of heat; such that elastic constrictive forces are imparted to the substrate. In one particular embodiment, for example, the waist elastic member 72 includes a plurality of dry-spun coalesced multifilament spandex elastomeric threads sold under the trade name LYCRA® and available from E.I. du Pont de Nemours and Company, Wilmington, Del., U.S.A. In another particular embodiment, for example, the waist elastic member 72 includes Findley HX 2695-01 adhesive laminated to two facings of 0.6 osy bicomponent polypropylene/polyethylene spunbond. Alternatively, six strands of 310 decitex LYCRA® may be also laminated at 250% elongation between the spunbond facings in addition to the Findley adhesive.

As described herein, the invention makes automated, or at least semi-automated, manufacture of three-dimensional garments 20 possible, with continuous and indexing processes combined into one system. More particularly, this invention combines a waist elastic member 72, a pant-like insert 28, and a three-dimensional garment shell 22 into a finished garment 20 by bonding these three components together at a waistband area 30, 24 of the insert 28 and the shell 22. The product 20 is bonded and trimmed on an expandable/retractable fixture. As a result, a three-dimensional garment 20 is formed.

It will be appreciated that details of the foregoing embodiments, given for purposes of illustration, are not to be construed as limiting the scope of this invention. Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention, which is defined in the following claims and all equivalents thereto. Further, it is recognized that many embodiments may be conceived that do not achieve all of the advantages of some embodiments, particularly of the preferred embodiments, yet the absence of a particular advantage shall not be construed to necessarily mean that such an embodiment is outside the scope of the present invention.

What is claimed is:

1. A method of making a three-dimensional garment, comprising the steps of:

loading an insert onto an expandable/retractable process loop fixture;

partially expanding the expandable/retractable process loop fixture;

loading a garment shell onto the expandable/retractable process loop fixture over the insert;

expanding the expandable/retractable process loop fixture;

attaching a waist area of the garment shell to the waist area of the insert;

retracting the expandable/retractable process loop fixture; and removing the garment from the expandable/retractable process loop fixture.

2. The method of claim 1, further comprising the step of attaching an elastic member to a waist area of the garment on the expandable/retractable process loop fixture.

3. The method of claim 2, further comprising the steps of tensioning the elastic member, bonding the elastic member to the waist area of the garment, and cutting the elastic member.

4. The method of claim 1, wherein the insert comprises a pant garment.

5. The method of claim 1, wherein the insert comprises an absorbent insert.

6. The method of claim 1, further comprising the step of fully expanding the expandable/retractable process loop fixture.

7. The method of claim 1, further comprising the step of trimming a portion of the waist area of the garment shell.

8. The method of claim 1, further comprising the step of trimming a portion of the waist area of the insert.

9. The method of claim 1, wherein the three-dimensional garment comprises a pant garment.

10. The method of claim 1, wherein the three-dimensional garment comprises a skirt.

11. The method of claim 1, wherein the three-dimensional garment comprises swimwear.

12. The method of claim 1, wherein the three-dimensional garment comprises a disposable absorbent garment.

13. A method of making a three-dimensional garment, comprising the steps of:

partially expanding an expandable/retractable process loop fixture;

loading a garment shell onto the expandable/retractable process loop fixture;

expanding the expandable/retractable process loop fixture;

attaching an elastic member to a waist area of the garment shell on the expandable/retractable process loop fixture;

retracting the expandable/retractable process loop fixture; and removing the garment from the expandable/retractable process loop fixture.

14. The method of claim 13, further comprising the steps of tensioning the elastic member, bonding the elastic member to the waist area of the garment shell, and cutting the elastic member.

15. The method of claim 13, further comprising the step of fully expanding the expandable/retractable process loop fixture.

16. The method of claim 13, further comprising the step of trimming a portion of the waist area of the garment shell.

17. The method of claim 13, wherein the three-dimensional garment comprises a pant garment.

18. The method of claim 13, wherein the three-dimensional garment comprises a skirt.

19. The method of claim 13, wherein the three-dimensional garment comprises swimwear.

20. Apparatus for making a three-dimensional garment, comprising:

at least one expandable/retractable process loop fixture;

a process loop about which the at least one expandable/retractable process loop fixture is transported;

a garment shell-loading station adjacent the process loop;

a waist band bonding device adjacent the process loop;

an expand station adjacent the process loop; and a retract station adjacent the process loop.

21. The apparatus of claim 20, further comprising an insert-loading station.

22. The apparatus of claim 21, wherein the insert-loading station comprises at least one expandable/retractable insert loop fixture on a track that is synchronized with the process loop.

23. The apparatus of claim 20, further comprising a partial-expand station.

24. The apparatus of claim 20, further comprising a full-expand station.

25. The apparatus of claim 20, further comprising a waist elastic applicator station.

26. The apparatus of claim 25, wherein the waist elastic applicator station comprises a walking beam indexer, an ultrasonic bonder, and at least two web guides.

27. The apparatus of claim 20, wherein the at least one expandable/retractable process loop fixture comprises an anvil and a trimming groove.

28. The apparatus of claim 20, wherein the at least one expandable/retractable process loop fixture comprises a locking device for expanding and retracting the three-dimensional garment.

29. The apparatus of claim 20, further comprising a garment shell-loading loop adjacent the process loop and in synchronization with the process loop.

30. The apparatus of claim 20, wherein the garment shell-loading loop comprises at least one expandable/retractable shell fixture.

31. A method of making a three-dimensional garment, comprising the steps of:

loading an insert onto an expandable/retractable process loop fixture;

loading a garment shell onto the expandable/retractable process loop fixture over the insert;

expanding the expandable/retractable process loop fixture;

attaching a waist area of the garment shell to the waist area of the insert;

trimming a portion of the waist area of the garment shell;

retracting the expandable/retractable process loop fixture; and removing the garment from the expandable/retractable process loop fixture.

32. The method of claim 31, further comprising the step of attaching an elastic member to a waist area of the garment on the expandable/retractable process loop fixture.

33. The method of claim 32, further comprising the steps of tensioning the elastic member, bonding the elastic member to the waist area of the garment, and cutting the elastic member.

34. The method of claim 31, wherein the insert comprises a pant insert.

35. The method of claim 31, wherein the insert comprises an absorbent insert.

36. The method of claim 31, further comprising the step of fully expanding the expandable/retractable process loop fixture.

37. The method of claim 31, further comprising the step of trimming a portion of the waist area of the insert.

38. The method of claim 31, wherein the three-dimensional garment comprises a pant garment.

39. The method of claim 31, wherein the three-dimensional garment comprises a skirt.

40. The method of claim 31, wherein the three-dimensional garment comprises swimwear.

41. The method of claim 31, wherein the three-dimensional garment comprises a disposable absorbent garment.

42. A method of making a three-dimensional garment, comprising the steps of:

loading an insert onto an expandable/retractable process loop fixture;

loading a garment shell onto the expandable/retractable process loop fixture over the insert;

expanding the expandable/retractable process loop fixture;

attaching a waist area of the garment shell to the waist area of the insert;

trimming a portion of the waist area of the insert;

retracting the expandable/retractable process loop fixture; and removing the garment from the expandable/retractable process loop fixture.

43. The method of claim 42, further comprising the step of attaching an elastic member to a waist area of the garment on the expandable/retractable process loop fixture.

44. The method of claim 43, further comprising the steps of tensioning the elastic member, bonding the elastic member to the waist area of the garment, and cutting the elastic member.

45. The method of claim 42, wherein the insert comprises a pant insert.

46. The method of claim 42, wherein the insert comprises an absorbent insert.

47. The method of claim 42, further comprising the step of fully expanding the expandable/retractable process loop fixture.

48. The method of claim 42, wherein the three-dimensional garment comprises a pant garment.

49. The method of claim 42, wherein the three-dimensional garment comprises a skirt.

50. The method of claim 42, wherein the three-dimensional garment comprises swimwear.

51. The method of claim 42, wherein the three-dimensional garment comprises a disposable absorbent garment.

52. A method of making a three-dimensional garment, comprising the steps of:

loading a garment shell onto an expandable/retractable process loop fixture;

expanding the expandable/retractable process loop fixture;

attaching an elastic member to a waist area of the garment shell on the expandable/retractable process loop fixture;

trimming a portion of the waist area of the garment shell;

retracting the expandable/retractable process loop fixture; and removing the garment from the expandable/retractable process loop fixture.

53. The method of claim 52, further comprising the steps of tensioning the elastic member, bonding the elastic member to the waist area of the garment shell, and cutting the elastic member.

54. The method of claim 52, further comprising the step of fully expanding the expandable/retractable process loop fixture.

55. The method of claim 52, wherein the three-dimensional garment comprises a pant garment.

56. The method of claim 52, wherein the three-dimensional garment comprises a skirt.

57. The method of claim 52, wherein the three-dimensional garment comprises swimwear.

* * * * *